US009327540B2

(12) United States Patent
Craswell et al.

(10) Patent No.: US 9,327,540 B2
(45) Date of Patent: May 3, 2016

(54) COLDSET WEB OFFSET PRINTING PROCESS AND COMPOSITION

(75) Inventors: Colin Craswell, Essex (GB); Stephen Wells, Milton Keynes (GB)

(73) Assignee: SUN CHEMICAL, B.V., Weesp (NL)

( * ) Notice: Subject to any disclaimer, the term of this patent is extended or adjusted under 35 U.S.C. 154(b) by 625 days.

(21) Appl. No.: 12/867,640

(22) PCT Filed: Feb. 24, 2009

(86) PCT No.: PCT/GB2009/000525

§ 371 (c)(1), (2), (4) Date: Aug. 13, 2010

(87) PCT Pub. No.: WO2009/106822

PCT Pub. Date: Sep. 3, 2009

(65) Prior Publication Data

US 2010/0326305 A1 Dec. 30, 2010

(30) Foreign Application Priority Data

Feb. 28, 2008 (GB) ..... 0803695.6

(51) Int. Cl.
*B41M 7/00* (2006.01)
*B41M 7/02* (2006.01)

(52) U.S. Cl.
CPC ..... *B41M 7/02* (2013.01); *Y10T 428/24868* (2015.01)

(58) Field of Classification Search
CPC ..... B41M 7/02; B41M 7/0036
USPC ..... 101/492, 424.2, 416.1; 118/46
See application file for complete search history.

(56) References Cited

U.S. PATENT DOCUMENTS

| | | | | |
|---|---|---|---|---|
| 6,143,074 | A | 11/2000 | Komori | |
| 2003/0113466 | A1 * | 6/2003 | Frazzitta et al. | 427/428 |
| 2003/0159602 | A1 | 8/2003 | Petersen et al. | |
| 2006/0230965 | A1 | 10/2006 | Thal | |
| 2007/0234913 | A1 * | 10/2007 | Angert et al. | 101/216 |
| 2008/0295712 | A1 | 12/2008 | Craswell et al. | |

FOREIGN PATENT DOCUMENTS

| | | | |
|---|---|---|---|
| EP | 0873867 | A2 | 10/1998 |
| EP | 1547772 | A1 | 6/2005 |
| JP | 2003340357 | A | 12/2003 |
| JP | 2006206802 | A * | 8/2006 |
| JP | 2006206802 | A | 8/2006 |
| WO | WO-2007087531 | A2 | 8/2007 |

OTHER PUBLICATIONS

BASF Corporation, Joncryl 90 Product Information, Jan. 1, 2007.*
"Aqueous Coatings: A Process and Equipment Primer"; (GAFTWorld, Mar./Apr. 1997, 9(2), pp. 17-20).
Examination Report, issued Feb. 7, 2011, in connection with corresponding European Patent Application No. 09715055.1 [4 pages].
Examination Report, issued Oct. 18, 2011, in connection with corresponding European Patent Application No. 09715055.1 [4 pages].
Examination Report, issued Sep. 19, 2012, in connection with corresponding European Patent Application No. 09715055.1 [3 pages].

* cited by examiner

*Primary Examiner* — Jennifer Simmons
(74) *Attorney, Agent, or Firm* — Charles C. Achkar; Ostrolenk Faber LLP

(57) ABSTRACT

By appropriate selection of an overprint varnish, so that it dries to no adhesion within 120 seconds, it is possible to coat one side only of newsprint or other similar substrates or to coat both sides of the substrate (without having regard to the relative times at which the sides are coated), without, in almost all cases, causing any fluting or curling of the substrate.

11 Claims, No Drawings

COLDSET WEB OFFSET PRINTING PROCESS AND COMPOSITION

The present invention relates to an improved coldset web offset printing process, and provides a printing ink composition for use therein.

Coldset web offset printing is most commonly used for printing newspapers, and is one of the cheapest and most economical methods of quickly printing large runs of printed matter. It is, however, generally regarded, rightly, as restrictive in the printed quality that can be achieved. The inks used consist basically of a pigment dispersed in a mineral/vegetable oil and binder and dry by absorption into the fibres of the substrate, e.g. newsprint. Particular problems experienced with this process include interpage set off (ink from one page marking an adjacent page or pages) and poor rub resistance, which results in ink coming off on the reader's hands. Thus, despite the economical process, this is not used for printing matter regarded as higher quality.

An obvious way of dealing with the problem would be to coat the printed matter with a water-based varnish that will prevent the ink from migrating either to other pages or to the hands of people holding the printed matter, and many trials of this nature have been made, all, so far as we are aware, without success. The main problems encountered were dimensional stability of the substrate, which resulted in fluting or curling of the coated substrate, and blocking, or sticking together of the web or substrate in the printing machine or post printed matter. Either of these problems by themselves would render the process unusable.

Any process used, if it is to be economically viable, must be easy to insert into a current printing process and must not add excessively to the cost. It must also not slow the overall printing process unduly. These factors are especially important when printing newspapers.

In WO 2007/087531 A2 we disclosed that these problems may be overcome by careful selection of two printing parameters: the first is the thickness of the overprint varnish (which may be defined in terms of the film weight); the second is the timing of coating the two sides of the printed sheet—the two sides should be coated either at or about the same time. Thus, the patent application claims a coldset web offset printing process in which matter is printed with a coldset printing ink onto a substrate and the printed substrate is then coated with a clear varnish to a film weight no more than 2 gsm (grams per square meter) on each side, the coating on one side taking place simultaneously with or within 0.5 seconds of coating of the other.

Although this process works very well, it necessitates coating both sides of a sheet, when, perhaps, only one side need be coated, thus wasting coating material, and requires that the coating take place within relatively tight tolerances, which is inconvenient in the newspaper industry. We have now discovered that, by appropriate selection of the overprint varnish, it is possible to coat one side only of newsprint or other such substrates or to coat both sides of the substrate (without having regard to the relative times at which the sides are coated), without, in almost all cases, causing any fluting or curling of the substrate Thus, the present invention consists in a coldset web offset printing process in which matter is printed with a coldset printing ink onto a substrate and the printed substrate is then coated with a clear varnish on at least one side, the varnish drying to no adhesion within 120 seconds, under the conditions of the following drying test.

In actual production, the drying time of the varnish will depend crucially on the composition of the varnish, but will also depend on the nature of the substrate. In order to assess drying speed in a less subjective way, the following drying test may be carried out:

Drying Test

1. A non-absorbent substrate (such as acetate) is placed on a firm, flat surface (such as a K-Bar print pad) and a film of the test varnish is applied using a green K-Bar—the Stop Watch is started at this point.
2. The non-absorbent substrate, with the cast film of varnish, is placed on the bed of a Duncan-Lynch Proofer and left uncovered.
3. After x seconds a section of an appropriate test substrate (i.e. the substrate onto which the varnish is to be coated) is placed over the test sample, the roller is lowered into contact and the pass made.
4. The non-absorbent substrate is removed from the Duncan-Lynch and the non-absorbent substrate and the test substrate are peeled apart. The level of adhesion to the non-absorbent substrate is assessed, from completely bonded to no adhesion, and recorded.
5. The above procedure is repeated, increasing by x seconds at each repeat, until there is no adhesion. At each repeat, the level of adhesion is assessed and recorded.
6. All the equipment should be cleaned thoroughly.

"x seconds" is the number of seconds to which the test is accurate. It is suitably 30 seconds, but may be a smaller or larger number of seconds, if greater or lesser precision is required in determining the point at which the varnish dries. Although it is desirable that x should be the same for each repeat, it is not essential.

The varnish should dry without the aid of UV, electron bombardment etc., although it may be assisted by heat.

Such a varnish will normally comprise at least a drying resin and a solvent or dispersant therefor. Normally, the crucial factor in the speed of drying will be the resin. Preferred resins for use in the present invention include styrene-acrylic (or methacrylic) copolymers, i.e. copolymers of styrene with acrylic acid, methacrylic acid, or a derivative thereof, such as an ester, amide, anhydride or the like. Specific examples of resins which may be used in the present invention include 33PDM294 (ex Johnson Polymer) and, Lucidine 141 or 143 (ex Rohm & Haas). Such resins are commonly supplied as aqueous solutions or emulsions and may be used as supplied. The varnish may also include small quantities of additives such as waxes, defoamers, wetting agents, etc.

The overprint varnish is preferably applied to a film weight no more than 4 gsm (grams per square meter), more preferably no more than 2 gsm. A film weight no more than 2 gsm equates broadly to a film thickness no greater than 20 microns. The preferred film weight is no greater than 1.5 gsm, still more preferably from 0.25 to 1.25 gsm, and most preferably from 0.5 to 1.0 gsm.

The conventional equipment used in, for example, newspaper printing merely needs modification to incorporate means to apply the clear overprint varnish after printing the text or other printed matter. Such equipment is well known to those skilled in the art, and, in the case of newspaper printing, may comprise a standard tower or satellite configured newspaper press. The additional means for coating the printed matter is also well known, and details may be found in, for example, "Aqueous Coatings: A Process and Equipment Primer" (GAFTWorld. March/April 1997, 9(2), pp 17-20). For example, standard roller coaters or an Anilox roller may be used.

Where, as is preferred, the overprint varnish is water-based, it will not mix easily with the oil-based coldset web offset printing ink, and may be applied as soon as practical after printing.

Although the overprint varnish is preferably applied soon after the coldset web offset printing ink has been printed onto the substrate, which will normally mean that the coldset web offset printing ink will not have dried fully, this is not necessary, and it is also possible to apply the overprint varnish to previously printed matter, on which the printing ink has already fully or partially dried.

The printing equipment may or may not be provided with heating means, e.g. means to direct hot air onto the printed or coated substrate. Where heating is available, this may aid drying. However, we have found that, where the amount of overprint varnish used is within the amounts suggested above, heating is not normally necessary in order to achieve good results.

The invention is further illustrated by the following non-limiting Examples.

EXAMPLE 1

Formulation

The following ingredients were mixed to prepare a varnish (amounts are percent by weight):

| | |
|---|---|
| 33 PDM 294 (ex Johnson Polymer BV) | 89.8 |
| LUCIDENE 141 Emulsion (ex Rohm & Haans) | 5.0 |
| Octafoam S-682 (ex Associated Octel) | 0.2 |
| ULTRALUBE E-810 K (ex KEIM-ADDITEC Surface GmbH) | 4.0 |
| SH112 Vestowax (ex Degussa AG) | 1.0 |

EXAMPLE 2

Formulation

This formulation is as disclosed as Example 1 of WO 2007/087531. The following ingredients were mixed to prepare a varnish (amounts are percent by weight):

| | |
|---|---|
| Water | 9.00 |
| Joncryl 90 (ex Johnson Polymer BV) | 44.80 |
| Joncryl 8050 (ex Johnson Polymer BV) | 13.00 |
| butyl diglycol ether BP (ex Brenntag (UK) Ltd.) | 3.00 |
| BYK 019 (ex BYK-Chemie GmbH) | 0.20 |
| water based acrylic varnish VR1922W (ex Sun Chemical) | 20.00 |
| Ultralube E810K (ex Keim-Additec Surface GmbH) | 4.00 |
| Vestowax SH112 Microwax (ex Degussa AG) | 0.50 |
| Aerosol OT75 (ex Cytec Australia Holding Pty Ltd.) | 2.80 |
| LO-VEL 27 (ex PPG Industries Inc) | 2.70 |
| Approximately 40% Solids/Viscosity 35-40 Seconds DX20. | |

EXAMPLE 3

Drying Test

A non-absorbent substrate (acetate) was placed on as a K-Bar print pad, and a film of the test over-print varnish (OPV) was applied to it, using a green K-Bar. Timing with a stop watch was started at this point.

The non-absorbent substrate, with the cast film of OPV, was placed on the bed of a Duncan-Lynch Proofer and left uncovered.

After 30 seconds a section of standard newspaper stock was placed over the test sample, the roller was lowered into contact and a pass made.

The non-absorbent substrate/cover sheet was removed from the Duncan-Lynch and the sheets were peeled apart. The level of adhesion was assessed, from completely bonded to no adhesion, and recorded.

The above procedure was repeated, increasing by 30 seconds at each step, until there was no adhesion. At each step the level of adhesion was assessed and recorded.

All the equipment was thoroughly cleaned.

The results are shown in Table 1 (Example 1) and Table 2 (Example 2).

TABLE 1

| | Complete Adhesion | Partial Adhesion | No Adhesion |
|---|---|---|---|
| 30 Seconds | | X | |
| 60 Seconds | | | X |
| 90 Seconds | | | X |
| 120 Seconds | | | X |

TABLE 2

| | Complete Adhesion | Partial Adhesion | No Adhesion |
|---|---|---|---|
| 30 Seconds | X | | |
| 60 Seconds | X | | |
| 90 Seconds | X | | |
| 120 Seconds | X | | |
| 150 Seconds | X | | |
| 180 Seconds | X | | |
| 210 Seconds | | X | |
| 240 Seconds | | X | |
| 270 Seconds | | | X |
| 300 Seconds | | | X |

The invention claimed is:

1. A coldset web offset printing process consisting essentially of:

a) selecting a clear varnish formulated to dry to no adhesion within 120 seconds of application of the varnish on a non-absorbent substrate without the aid of UV, electron bombardment or heat;

wherein drying performance of the varnish has been determined by a drying test consisting essentially of:

i. applying a film of the varnish onto the non-absorbent substrate, wherein the varnish is applied to the non-absorbent substrate to a film weight of not more than 4 grams per square meter;

ii. placing the non-absorbent substrate onto the bed of a Duncan-Lynch Proofer and leaving it uncovered;

iii. waiting 30 seconds;

iv. placing a test substrate consisting of the substrate to be printed on in step b) below, lowering the roller of the Duncan-Lynch Proofer, and rolling for one pass;

v. removing the non-absorbent substrate and the test substrate from the Duncan-Lynch Proofer;

vi. peeling the non-absorbent substrate and the test substrate apart;

vii, measuring how much of the varnish is removed from the non-absorbent substrate and adheres to the test substrate;

viii. repeating steps i) to vii), waiting an additional 30 seconds for each subsequent repetition;

ix, wherein the varnish is dried to no adhesion when none of the varnish adheres to the test substrate;

b) printing a coldset printing ink onto a substrate to form a printed substrate; and c) applying the clear varnish to one side of the printed substrate;

wherein the varnish is water-based and is applied to a film weight of not more than 4 grams per square meter.

2. The process of claim 1, in which the substrate is newsprint.

3. The process of claim 1, in which the varnish is applied to a film weight of not more than 2 grams per square meter.

4. The process of claim 1, in which the varnish is applied to a film weight of not more than 1.5 grams per square meter.

5. The process of claim 1, in which the varnish is applied to a film weight of not more than 1.25 grams per square meter.

6. The process of claim 1, in which the varnish is applied the printed substrate to a film weight of 0.5 to 1 gram per square meter.

7. The process of claim 1, further comprising providing a heating means and heating printed substrate after the clear varnish is applied.

8. The process of claim 1, wherein the varnish comprises a styrene-acrylic or styrene-methacrylic copolymer.

9. Printed material prepared by the process of claim 2.

10. Printed material prepared by a process of claim 1.

11. A printing process to avoid fluting or curling of a printed substrate consisting essentially of:

a) selecting a clear varnish containing a drying resin and a solvent or dispersant therefor formulated to dry to no adhesion within 120 seconds of application on a non-absorbent substrate without the aid of UV, electron bombardment or heat;

wherein drying performance of the varnish is determined by a drying test consisting essentially of:

i. applying a film of the varnish onto the non-absorbent substrate, wherein the varnish is applied to the non-absorbent substrate to a film weight of not more than 4 grams per square meter;

ii. placing the non-absorbent substrate onto the bed of a Duncan-Lynch Proofer and leaving it uncovered;

iii. waiting 30 seconds;

iv. placing a test substrate consisting of the substrate to be printed on in step b) below, lowering the roller of the Duncan-Lynch Proofer, and rolling for one pass;

v. removing the non-absorbent substrate and the test substrate from the Duncan-Lynch Proofer;

vi. peeling the non-absorbent substrate and the test substrate apart;

vii. measuring how much of the varnish is removed from the non-absorbent substrate and adheres to the test substrate;

viii. repeating steps i) to vii), waiting an additional 30 seconds for each subsequent repetition;

ix. wherein the varnish is dried to no adhesion when none of the varnish adheres to the test substrate;

b) printing a coldset printing ink onto a substrate to form the printed substrate; and c) applying the clear varnish to one side of the printed substrate;

wherein the varnish is water-based and is applied to a film weight of not more than 4 grams per square meter; and, wherein the process is coldset web offset.

* * * * *